US006325647B1

(12) United States Patent
May et al.

(10) Patent No.: US 6,325,647 B1
(45) Date of Patent: Dec. 4, 2001

(54) ELECTRICAL PLUG CONNECTOR

(75) Inventors: Guntram May, Altdorf; Steffen Muller, Nuremberg, both of (DE)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/634,221

(22) Filed: Aug. 9, 2000

(30) Foreign Application Priority Data

Aug. 17, 1999 (DE) ..... 199 38 930

(51) Int. Cl.[7] ..... H01R 13/62
(52) U.S. Cl. ..... 439/157; 439/372
(58) Field of Search ..... 439/157, 152, 439/160, 153, 372

(56) References Cited

FOREIGN PATENT DOCUMENTS

| | | |
|---|---|---|
| 19704312 A1 | 8/1998 | (DE) . |
| 29802142 U1 | 7/1999 | (DE) . |
| 0273999 A2 | 7/1988 | (EP) . |
| 0676830 A2 | 10/1995 | (EP) . |
| 0692846 A2 | 1/1996 | (EP) . |

*Primary Examiner*—Khiem Nguyen
*Assistant Examiner*—Javaid Nasri
(74) *Attorney, Agent, or Firm*—Perman & Green, LLP

(57) ABSTRACT

An electrical plug connector is described, which has a U-shaped locking clip (30), two mutually parallel running limbs (32, 33) and a base (31) running essentially at right angles to them, a connector housing (1) having two pins (21, 22) which are integrally formed on a pivoting shaft (20) on the opposite side surfaces (18, 19) of the connector housing, pointing outwards, and on which the free ends (36, 37) of the limbs (32, 33) are hinged, and comprises a mating connector housing (2) having an apron (4), in which the clip (30) and the mating connector housing (2) have complimentary engagement elements (39, 12) for inserting the connector housing (1) into the mating connector housing (2). At least one of the two limbs (32, 33) has a lever arm (50) which can pivot elastically about a rotation shaft (60) and has a projection (74), which rests on the side surface (18 or 19) at the level of the pivoting shaft (60), in which the rotation shaft (60) essentially coincides with the longitudinal axis of the limb (32, 33), and the mechanical connection between the head end (51) of the lever arm (50) and a latching element (25, 26) fitted on the corresponding side surface (18, 19) of the connector housing (1) can be released, in that the apron (4) extends onto the foot end (53) of the lever arm (50) when the connector housing (1) is inserted into the mating connector housing (2).

9 Claims, 3 Drawing Sheets

ELECTRICAL PLUG CONNECTOR

FIELD OF THE INVENTION

The invention relates to an electrical plug connector and in particular an electrical plug connector with a U-shaped locking clip.

DESCRIPTION OF THE PRIOR ART

Electrical plug connectors having locking clips are used, for example, for motor vehicles, where they are often located at points where access is difficult, for example on the rear face of the dashboard. For space reasons, the connector housing may often project from the mating connector housing, when the plug connector is mated, to such a small extent that it cannot be gripped well enough to pull it out conveniently.

Such a plug connector has been disclosed in the document EP 0 273 999 A2, which has a plug housing and a socket housing, with at least one toothed rod being arranged on one of the two housings, which toothed rod can be moved at right angles to the insertion direction and engages with a pinion area on an operating pivoting lever, which is mounted such that it can pivot about the pinion shaft, between an open position and a closed position.

Furthermore, a lockable plug connection has been disclosed in the document EP 0 692 846 A2, which likewise has a connector housing about which a lever is hinged at the side, for locking. The connector housing and the lever furthermore have a latching tab and a latching hole for fixing in the prelatched position.

In this case, it is disadvantageous that, in the former case, no latching elements are provided in order to fix the operating pivoting lever in a prelatched position so that it can engage such that it fits its toothed rods. In the second case, the latching tabs and the latching holes are not large enough, which allows the pivoting lever to be released during transportation. In this case, the fitter has to move the pivoting lever back to its prelatched position. When inserting the connector into the mating connector, the fitter also has to overcome the latching elements of the locking clip, in addition to this insertion resistance.

SUMMARY OF THE INVENTION

The object of the invention is to provide an electrical plug connector having a locking clip, which on the one hand is fixed in its prelatched position, and on the other hand can be pivoted out of this position when required.

The electrical plug connector according to the invention comprises a U-shaped locking clip which may have two mutually parallel running limbs and a base running essentially at right angles to them. Furthermore, this electrical plug connector may have a connector housing having two pins which are integrally formed on its opposite side surfaces, pointing outwards on a pivoting shaft, and on which the free ends of the limbs are hinged, and a mating connector housing, which has an apron in which the locking clip and the mating connector housing have complementary engagement elements for inserting the connector housing into the mating connector housing. Furthermore, the clip and the mating connector housing may have complementary engagement elements for inserting the connector housing into the mating connector housing. In this case, at least one of the two limbs may have an elastic lever arm which can pivot about a rotation shaft, with the rotation shaft essentially coinciding with the longitudinal axis of the limb. The mechanical connection can be released between the head end of the lever arm and a latching element fitted on the corresponding side surface of the connector housing in that the apron extends onto the foot end of the lever when the connector housing is inserted into the mating connector housing.

The invention offers the advantage that, on the one hand, the locking clip is fixed firmly in its prelatched position on the connector housing and, on the other hand, this fixing is released simply by inserting the connector housing into the mating connector. In the process, the locking clip is even automatically pivoted somewhat, so that the fitter can grip it better.

Further advantageous refinements of the invention are specified in the dependent claims.

DETAILED DESCRIPTION OF THE INVENTION

Figure 1:
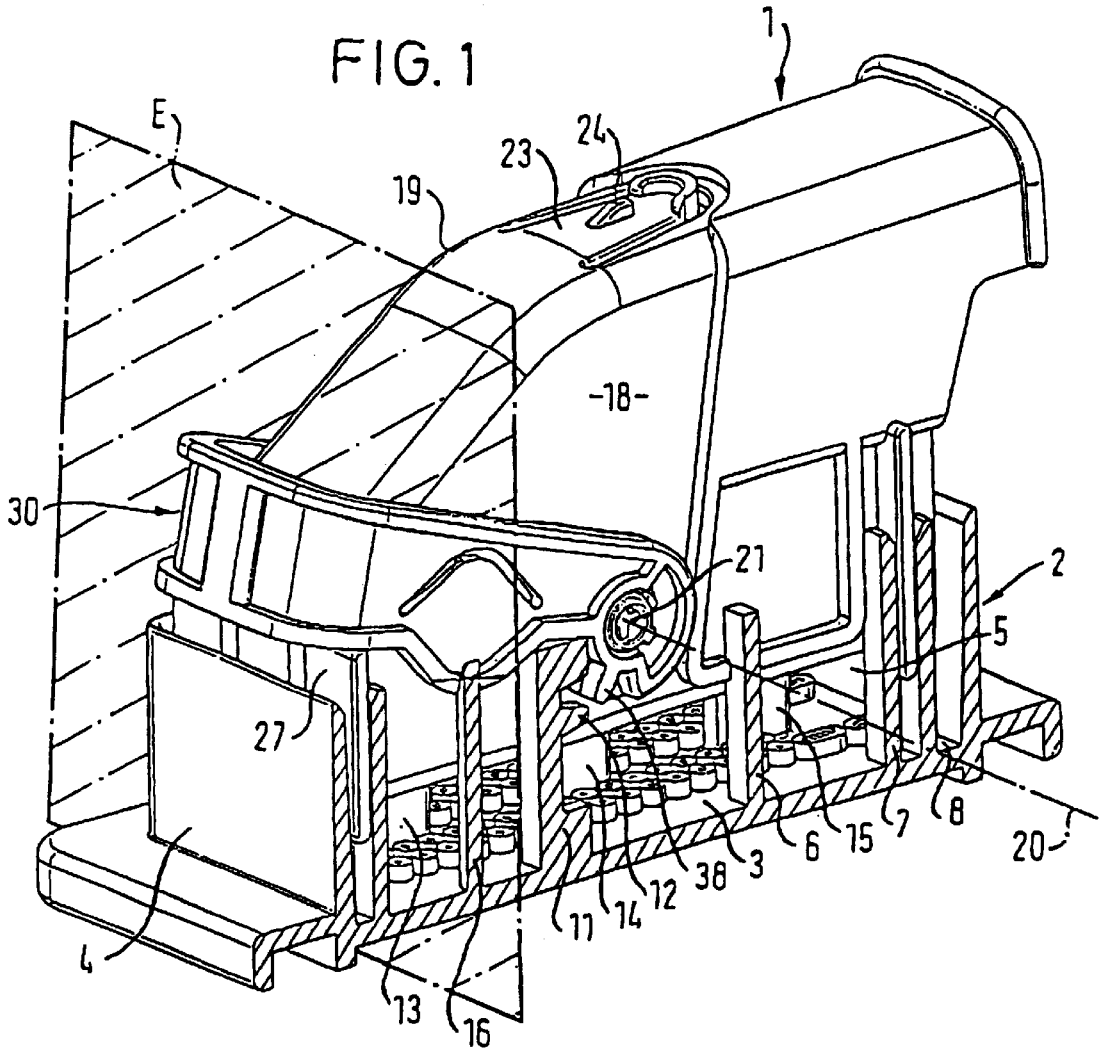
FIG. 1 shows an oblique view from above of the side of the plug connector according to the invention, in the partially inserted state.

FIG. 1 shows the plug connector according to the invention in the partially inserted state, with the longitudinal side wall of the mating connector housing 2 being cut away to assist clarity. This essentially rectangular mating connector housing 2 has a base plate 3, on which an apron 4 is integrally formed, which runs at right angles in the insertion direction and surrounds a holder 5. Various guide shoulders 6, 7 and 8 are integrally formed on the apron 4, projecting into the holder 5, with these guide shoulders 6, 7 and 8 extending over the entire height of the apron 4 in the insertion direction. Furthermore, the mating connector 2 has a release shoulder 16, which likewise points into the holder 5, runs along the insertion direction and is inclined at the beginning portion of the apron. A toothed rod 11 which has a tooth 12 is likewise integrally formed such that it projects into the holder 5, runs in the insertion direction, and is integrally formed on the apron 4. Various guide webs 13, 14 and 15 are integrally formed essentially in the centre of the holder 5, along the insertion direction, but their height is less than that of the apron 4.

A connector 1 is partially inserted in the holder 5 of the mating connector 2. The connector face is shaped to be complementary to the holder 5 and, furthermore, has cutouts for the guide shoulders 6, 7 and 8 and for the guide webs 13, 14 and 15. Pins 21 and 22 which project outwards and are aligned with a pivoting shaft 20 are integrally formed on the side surfaces 18 and 19 of the connector housing 1, acting as a hinge for a locking clip 30. A release tongue 23 having a locking hook 24 is fitted on the upper face of the connector housing 1, so that the locking clip 30 is fixed in its final latched position there.

Figure 2:
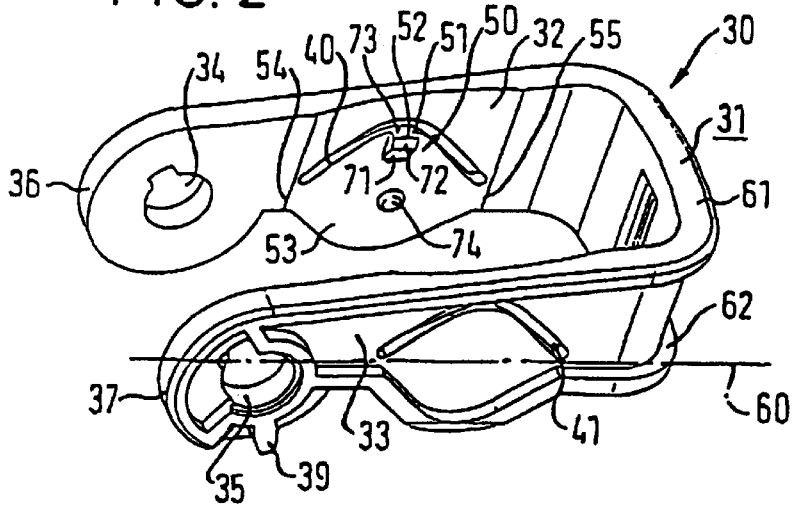
FIG. 2 shows an oblique view of the locking clip.

FIG. 2 shows an oblique view of a locking clip 30 with a base 31 and limbs 32 and 33 integrally formed at right angles to it. Each limb 32 and 33 has a hole 34 and 35 at its free end to accommodate the pins 21 and 22 of the connector housing. Furthermore, a tooth 38 and 39 is integrally formed radically with respect to the hole 34 and 35 at free ends 36 and 37, in order to make it possible to interact with the tooth 12 on the toothed rod 11. The locking clip is formed by a flat, broad elastic strip which extends at right angles to the base 31 and at right angles to the limbs 32 and 33.

A V-shaped cutout 40 and 41 is incorporated essentially in the centre of each limb 32 and 33, which surrounds a head end 51 of a lever arm 50. A latching tab 52, which projects inwards, is integrally formed on the head end 51. The lever arm 50 is incorporated in the flat strip and extends at right angles to the longitudinal direction of the limbs 32 and 33, with the foot end 53 of the lever arm 50 being expanded by means of a bulge which points downwards, in such a manner that the lever arm has the form of a lens. The lever arm 50 and the regions 54 and 55 are connected to the limbs. A rotation axis 60 passes through these two regions 54 and 55 and runs essentially through the longitudinal direction of the limbs. In this case, the lever arm 50 can be tilted about this rotation axis 60 since the strip from which the locking clip is formed is composed of elastic material. A collar 61 which points outwards is integrally formed on the upper edge of the locking clip 30, running from one end 36 to the other end 37. A second collar 62 is likewise integrally formed on the lower edge, which points outwards, running over the entire clip, that is to say from one end 36 to the other end 37, and is inclined in the regions of the foot ends of the lever arm 50.

The method of operation of this locking clip according to the invention will be explained in more detail with the aid of FIG. 3.

Figure 3:
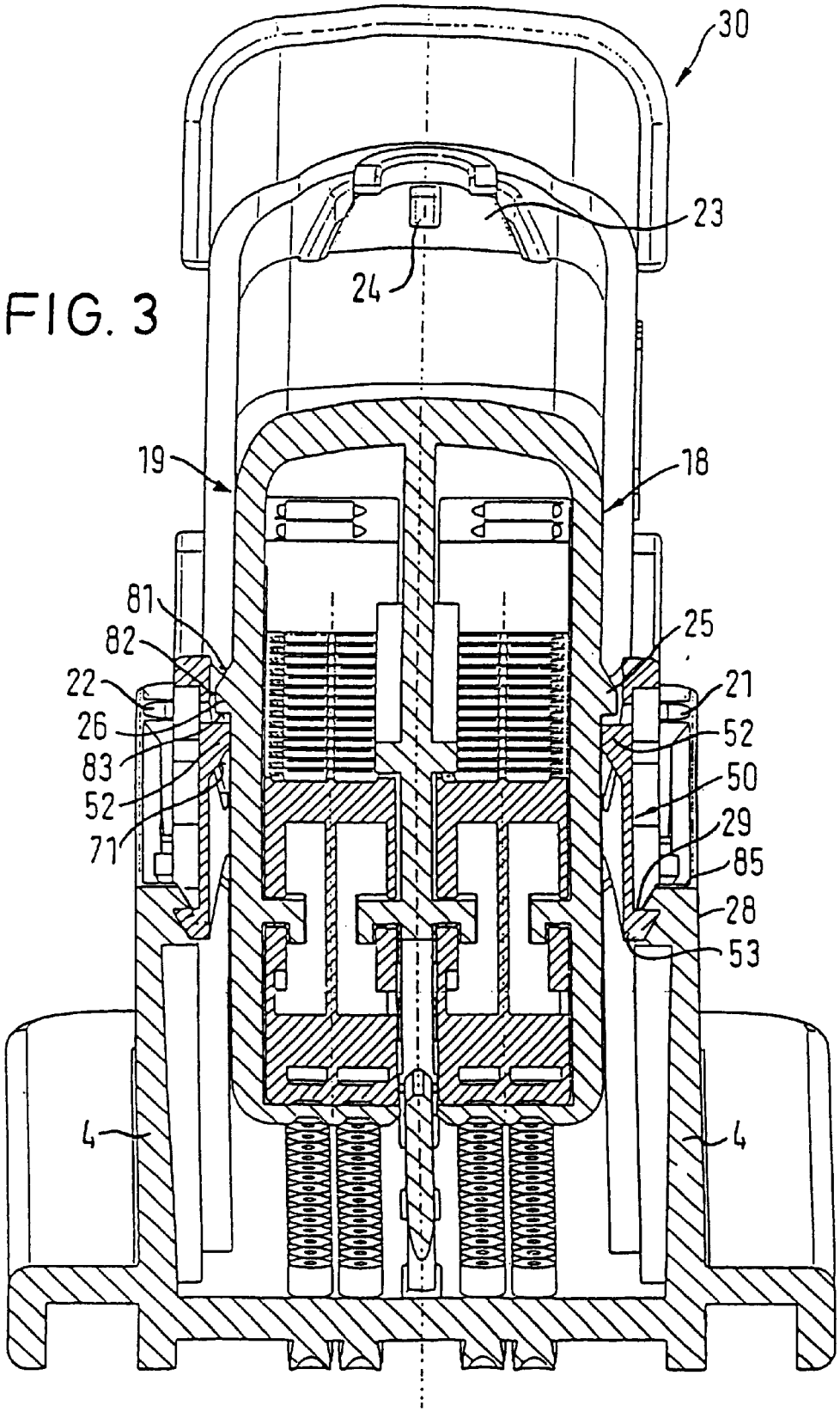
FIG. 3 shows a section along the plane E in FIG. 1.

FIG. 3 shows a section along the plane E from FIG. 1.

As can be seen in FIG. 1, the locking clip 30 is arranged around the connector housing 1 in such a manner that the limb 32 runs parallel to the side surface 18, and the other limb 33 runs in a corresponding manner parallel to the side surface 19, being inserted in the corresponding holes 34 and 35. The locking clip 30 must be hinged on the connector housing 1 in such a manner that the two inclined foot ends 53 point, in the prelatched position, towards the connector face of the connector housing. Two latching hooks 25 and 26 are integrally formed diametrically opposite one another on the outside on the side surfaces 18 and 19, in such a manner that, in the prelatched position as shown in FIGS. 1 and 3, the latching tabs 52 on both lever arms 50 rest against the side surfaces 18 and 19 and butt against these latching hooks 25 and 26 if they are pivoted outwards. These latching hooks 25 and 26 thus effectively prevent the locking clip from pivoting upwards inadvertently. The latching tabs 52 are surrounded by a ramp 71, a flattened ridge 72 running parallel to the limb, and a surface 73 at right angles to it. The latching hooks 25 and 26 are likewise surrounded by a ramp 81, a flattened ridge 82 running parallel to the side surface 18 and 19, and a surface 83 at right angles to it. When the locking clip 30 is in the prelatched position, the ridge 72 of the latching tab 52 touches the side surface 19, with the two vertical surfaces 73 and 83 being opposite, and even touching. The lower edge of the locking clip 30 touches a guide wall 27 of the connector housing 1.

It is thus impossible to pivot the locking clip 30 in one of the two directions since, when the locking clip is pivoted upwards, the vertical surface 73 of the latching tab 52 abuts against the vertical surface 83 of the latching hook 26, and, in the other direction, the guide wall 27 acts as a stop.

Figure 4:
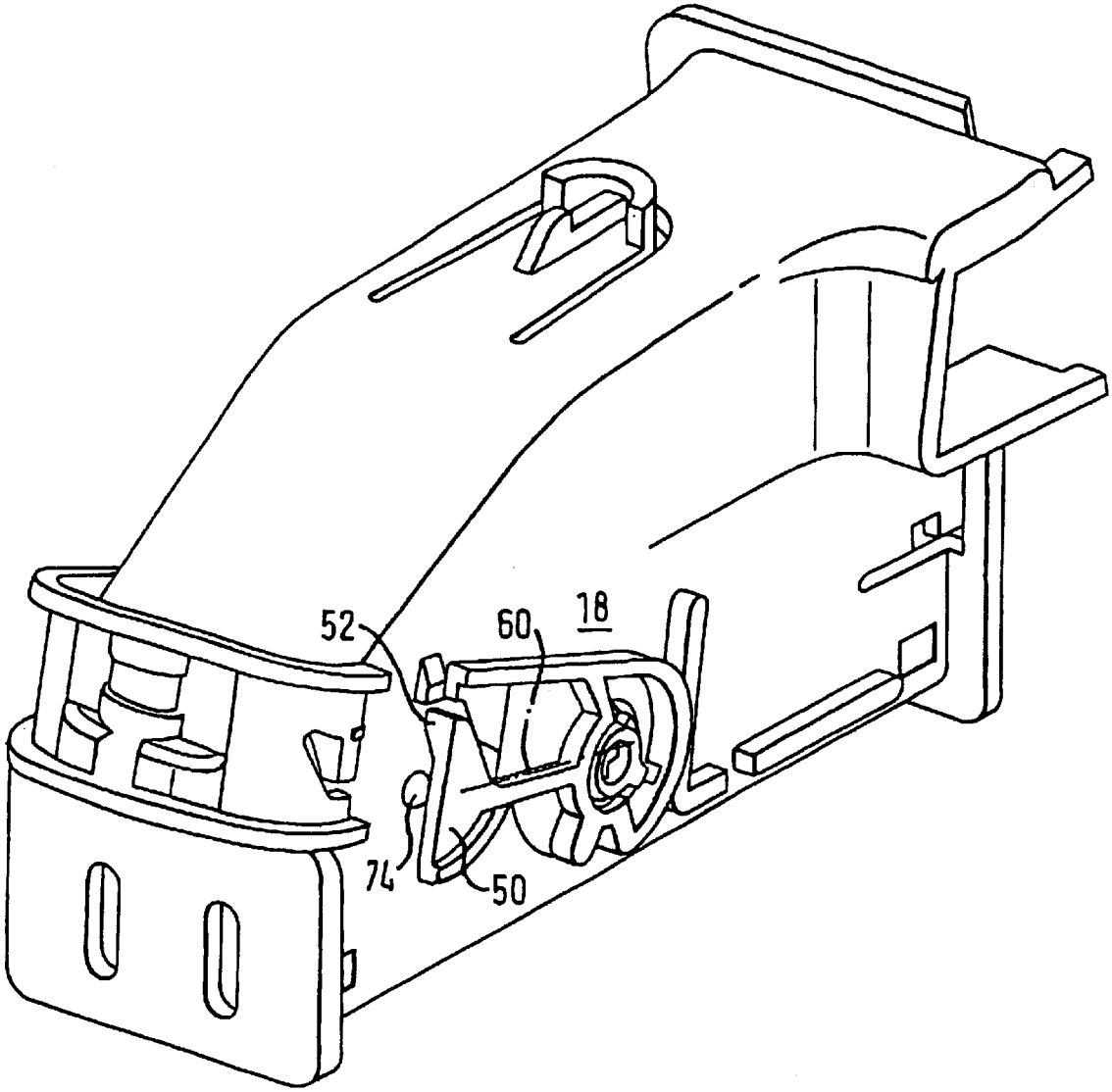
FIG. 4 shows an oblique view as in FIG. 1, partially cut away in the region of the lever

If the connector housing is now inserted with the locking clip 30, located in the prelatched position, into the mating connector housing 2, then the two free ends 36 and 37 of the locking clip enter the holder 5, so that the tooth 39 is arranged in the vicinity of the toothed rod 11. When the connector housing is introduced further into the mating connector housing 2, the foot end 53 of the lever 50 comes into contact with the release shoulder 16 or, as is shown in FIG. 3, with an inclined release projection 28, so that the release shoulder 16 or the release projection 28 presses against the inclined collar 62 on the foot end 53 of the lever 50, so that the lever arm 50 rotates about its rotation axis 60, with one latching tab 52 being raised off the side 19 via the latching hook 26. In the process, the lever 50 is supported on the side surface 18 or 19, respectively, by means of a projection 74, which is arranged at the level of the rotation axis 60 as shown in FIG. 2 and FIG. 4. This avoids the rotation axis 60 bending when it is pressed onto the foot end of the lever, which would make it impossible to release the latching tab. It is likewise possible for the projection or two projections to be arranged on the corresponding side surfaces 18 or 19, respectively, in which case care must be taken to ensure that this does not interfere with the latching tab 52. An arrangement offset at the side is thus required in this case. In a corresponding manner, the other latching tab 52, which is arranged on the side surface 18, is raised via the latching hook 25. It should be noted that, in FIG. 3, the foot end 53 slides past the release projection 28. This does not correspond to the actual design. On the one hand, the lever arm 50 is shown in the unstressed position. On the other hand, it can be seen that the distance between the two release projections 28 is shorter than the distance between the two foot ends, in order that the lever 50 is tilted during insertion.

The latching tabs 52 on the two limbs 32 and 33 can now slide past the latching hooks 25 and 26. Further insertion of the connector housing into the mating connector housing 2 results in the lower edge 62 of the locking clip 30 reaching the apron 4 in the region of the base 31 and, correspondingly, being pivoted upwards so that, on the one hand, the two latching tabs 52 on the two limbs 32 and 33 pass over the latching hooks 25 and 26 and, on the other hand, the two teeth 39 at the free ends 36 and 37 engage in the toothed rod 11. The fitter can now pivot the locking clip 30 upwards until the base enters the locking hook 24. In the process, the two teeth 39 pull the connector housing into the mating connector housing.

In order to open the plug connector, the fitter just needs to press on the tongue 23, so that the locking hook 24 releases the base 3 of the locking clip 30, and pivots the locking clip 30 in the prelatched direction. In a corresponding way, the connector housing 1 is raised out of the mating connector housing 2 by virtue of the tooth 38, 39 on the limbs 32 and 33. If the locking clip 30 is pivoted further upwards, the ramp 71 on the latching tab 52 comes into contact with the ramp 81 on the latching hook 26. In the process, the lever 50 is once again tilted about its rotation axis 60 until the latching tab 52 has overcome the latching hook 26, so that the flattened ridge 72 comes into contact with the side surface 19 of the connector housing 1. The electrical plug connector is now ready for use once again.

The above description of exemplary embodiments of the present invention should not be regarded as representing any limitation, but is merely illustrative.

What is claimed is:

1. An electrical plug connector having a U-shaped locking clip having two mutually parallel running limbs and a base running essentially at right angles to the limbs;

a connector housing having two pins which are integrally formed on a pivoting shaft positioned on opposite side surfaces of the connector housing, pointing outwards, and in which free ends of the limbs are hinged; and a mating connector housing having an apron, in which the clip and the mating connector housing have complementary engagement elements for inserting the connector housing into the mating connector housing (2), wherein at least one of the two limbs has a lever arm which can pivot elastically about an axis of rotation and has a projection at the level of the axis of rotation which rests on a side surface of the connector housing, in which the axis of rotation essentially coincides with a longitudinal axis of the limb and a mechanical connection between a head end of the lever arm and a latching element fitted on the corresponding side surface of the connector housing can be released, wherein the apron extends onto a foot end of the lever arm when the connector housing is inserted into the mating connector housing.

2. An electrical plug connector according to claim 1, wherein said head end includes a latching tab pointing towards an opposite limb and is surrounded by a ramp, a flattened ridge running parallel to the limb and a surface at right angles to the limb, with the ridge resting on said side surface.

3. An electrical plug connector according to claim 1, wherein said latching element is a latching hook pointing outwardly and is surrounded by another ramp, another flattened ridge running parallel to said side surface and by another surface at right angles to said latching hook, with said latching hook being arranged on the side surface such that, when said locking clip is in a pivoted-up state, the vertical surface of a latching tab and the vertical surface of said latching hook rest on one another.

4. An electrical plug connector according to claim 1, wherein said apron has at least one release shoulder, which runs in the insertion direction, projects inwards and is arranged in such a manner that, during insertion, said release shoulder extends onto said foot end, with the shoulder having, in an entry region, a tab which points inwards and has an inclined end face and a rear face running transversely with respect to the insertion direction.

5. An electrical plug connector according to claim 1, wherein said clip is in the form of a flat, broad and upright strip, with said lever arms being incorporated in the upright strip.

6. An electrical plug connector according to claim 5, wherein, at the level of each of said two limbs said strip has an essentially V-shaped cutout surrounding said head end and bulging outwardly towards said foot end in such a way that said lever arm is essentially in the form of a lens.

7. An electrical plug connector according to claim 5 wherein a lower and upper outer edge of said clip include a collar, and the lower outer edge includes a second collar, which is inclined inwards at the level of said foot ends.

8. An electrical plug connector according to claim 1, wherein at least one toothed rod which runs parallel to the insertion direction and is fitted on said matting connector housing, and at least one tooth located on said essentially circular free end form engagement elements, whereby the tooth engages in said toothed rod when said clip is pivoted.

9. An electrical plug connector according to claim 1, wherein said connector housing and said clip include holding elements adapted to be released and engage in said clip when said clip reaches a position where said connector housing and said mating connector housing are locked.

* * * * *

UNITED STATES PATENT AND TRADEMARK OFFICE

CERTIFICATE OF CORRECTION

PATENT NO. : 6,325,647 B1
DATED : December 4, 2001
INVENTOR(S) : May et al.

It is certified that error appears in the above-identified patent and that said Letters Patent is hereby corrected as shown below:

Title page,
Item [54] Title, ELECTRICAL PLUG CONNECTOR HAVING A U-SHAPED LOCKING CLIP

Signed and Sealed this

Twenty-first Day of May, 2002

*Attest:*

*Attesting Officer*

JAMES E. ROGAN
*Director of the United States Patent and Trademark Office*